US009644598B2

(12) United States Patent
Achtstätter et al.

(10) Patent No.: US 9,644,598 B2
(45) Date of Patent: May 9, 2017

(54) CORONA IGNITION DEVICE

(71) Applicant: BorgWarner Ludwigsburg GmbH, Ludwigsburg (DE)

(72) Inventors: Tom Achtstätter, Hemmingen (DE); Timo Stifel, Korntal-Münchingen (DE)

(73) Assignee: BorgWarner Ludwigsburg GmbH, Ludwigsburg (DE)

( * ) Notice: Subject to any disclaimer, the term of this patent is extended or adjusted under 35 U.S.C. 154(b) by 43 days.

(21) Appl. No.: 14/480,987

(22) Filed: Sep. 9, 2014

(65) Prior Publication Data

US 2015/0075472 A1 Mar. 19, 2015

(30) Foreign Application Priority Data

Sep. 17, 2013 (DE) ..... 10 2013 110 246

(51) Int. Cl.
*F02P 23/04* (2006.01)
*H01T 13/44* (2006.01)
*F02P 13/00* (2006.01)

(52) U.S. Cl.
CPC ..... *F02P 23/04* (2013.01); *H01T 13/44* (2013.01); *F02P 13/00* (2013.01)

(58) Field of Classification Search
CPC H01T 13/44; H01T 13/34; F02P 23/04; F02P 13/00
See application file for complete search history.

(56) References Cited

U.S. PATENT DOCUMENTS

| | | | | |
|---|---|---|---|---|
| 3,229,032 | A * | 1/1966 | Willis | H01T 13/34 174/152 S |
| 8,767,372 | B2 | 7/2014 | Stifel et al. | |
| 2010/0175653 | A1* | 7/2010 | Lykowski | H01T 13/04 123/143 C |
| 2011/0269555 | A1* | 11/2011 | Morimoto | C21D 1/10 464/106 |
| 2012/0180743 | A1 | 7/2012 | Burrows et al. | |
| 2013/0199484 | A1 | 8/2013 | Stifel et al. | |
| 2014/0131316 | A1 | 5/2014 | Gentsch et al. | |

FOREIGN PATENT DOCUMENTS

| | | | |
|---|---|---|---|
| CN | 103061950 | A | 4/2013 |
| DE | 10 2010 055 570 | B3 | 3/2012 |
| EP | 2 551 878 | A1 | 1/2013 |
| WO | WO 2012/097212 | A1 | 7/2012 |

* cited by examiner

*Primary Examiner* — Jacob Amick
(74) *Attorney, Agent, or Firm* — Bose McKinney & Evans LLP

(57) ABSTRACT

A corona ignition device for igniting fuel in an internal combustion engine by means of a corona discharge. The device comprises a center electrode, an insulator into which the center electrode is inserted, a coil body onto which a coil that is connected to the center electrode is wound, and a shielding cap which is fitted onto an end section of the coil body. The end section faces the insulator. According to this disclosure, the shielding cap comprises one or a plurality of slots.

14 Claims, 4 Drawing Sheets

CORONA IGNITION DEVICE

RELATED APPLICATIONS

This application claims priority to DE 10 2013 110 246.8, filed Sep. 17, 2013, which is hereby incorporated herein by reference in its entirety.

BACKGROUND

The present invention relates to a corona ignition device for igniting fuel in an internal combustion engine by means of a corona discharge. Such a corona ignition devices are generally known from DE 10 2010 055 570 B3.

The dielectric strength has turned out to be a problem in the operation of corona ignition devices. In known corona ignition devices, voltage flashovers and partial discharges often result in a premature failure. The risk of voltage flashovers can be considerably reduced by fitting a shielding cap onto an end section of the coil body that is facing the insulator body.

The shielding cap of the corona ignition device known from DE 10 2010 055 570 B3 has an H-shaped cross section. On one side, the shielding cap is fitted onto the end section of the coil body and on the other side onto an end section of the insulator. The center electrode is connected to the coil in an electrically conducting manner via the bottom of the shielding cap. To achieve this, a contact bushing can be arranged on the bottom of the shielding cap, said contact bushing facilitating an electrical plug connection for connecting the coil.

SUMMARY

This disclosure teaches how a corona ignition device can be refined further.

Due to the fact that the shielding cap comprises one or a plurality of slots in its circumferential wall, it is possible to reduce eddy current losses. In this manner, the efficiency can be advantageously increased and the service life be extended.

In a corona ignition device according to this disclosure, a section of the center electrode can protrude through the bottom of the shielding cap. In this manner, a pin which facilitates connecting the coil to the center electrode is present in the interior region of the shielding cap. For example, the coil body can carry a bush which is fitted onto this center electrode section. As a result, the production of the corona ignition device can be simplified.

The shielding cap can be formed integrally with the pin which forms a section of the center electrode. It is also possible that the shielding cap is joined on to the pin which forms a section of the center electrode. For example, the shielding cap can be connected to the pin by pressing or it can be screwed to it. It is also possible that the shielding cap is welded to the pin. In this case, it is important that the weld seam which connects the shielding cap to the pin be arranged completely in the interior region of the shielding cap. Otherwise, the weld seam, being a local ridge on the outside of the shielding cap, can cause field elevations and result in discharges. This can be avoided if the weld seam is completely arranged in the shielding cap, i.e., the pin and the shielding cap are subject to an influence from welding only from the interior region of the shielding cap.

Different welding techniques can be used to weld the shielding cap to the pin, for example, laser welding, friction welding or resistance welding. The preferred technique is laser welding because thereby a joint between the pin and the shielding cap can easily be worked on from the interior region of the shielding cap and, as a consequence, the weld seam is exclusively disposed in the interior region of the shielding cap.

A further advantageous refinement of this disclosure provides that the shielding cap comprises a circumferential wall which projects on one side only beyond the bottom of the shielding cap through which the center electrode protrudes. Such a shielding cap has a U-shaped cross section. In this manner, the production of the shielding cap and the assembly of the corona ignition device can be considerably simplified. Surprisingly, such a cup-shaped shielding cap having a U-shaped cross section allows achieving shielding results that are as good as those achieved with shielding caps having an H-shaped cross section.

For example, the shielding cap can be made of copper, silver, aluminum or any another well-conducting metal. The shielding cap can but does not necessarily have to be made completely of a well-conducting material. It is sufficient to have a surface coating made of a well-conducting metal. Such a coating can, for example, have a thickness of 0.1 mm or more.

BRIEF DESCRIPTION OF THE DRAWINGS

The above-mentioned aspects of exemplary embodiments will become more apparent and will be better understood by reference to the following description of the embodiments taken in conjunction with the accompanying drawings, wherein.

DETAILED DESCRIPTION

The embodiments described below are not intended to be exhaustive or to limit the invention to the precise forms disclosed in the following detailed description. Rather, the embodiments are chosen and described so that others skilled in the art may appreciate and understand the principles and practices of this disclosure.

Figure 1:
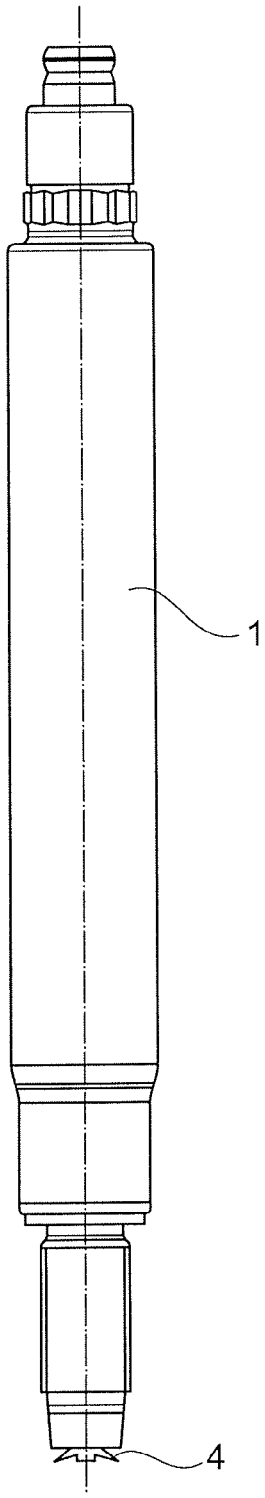
FIG. 1 shows an embodiment of a corona ignition device.
Figure 2:
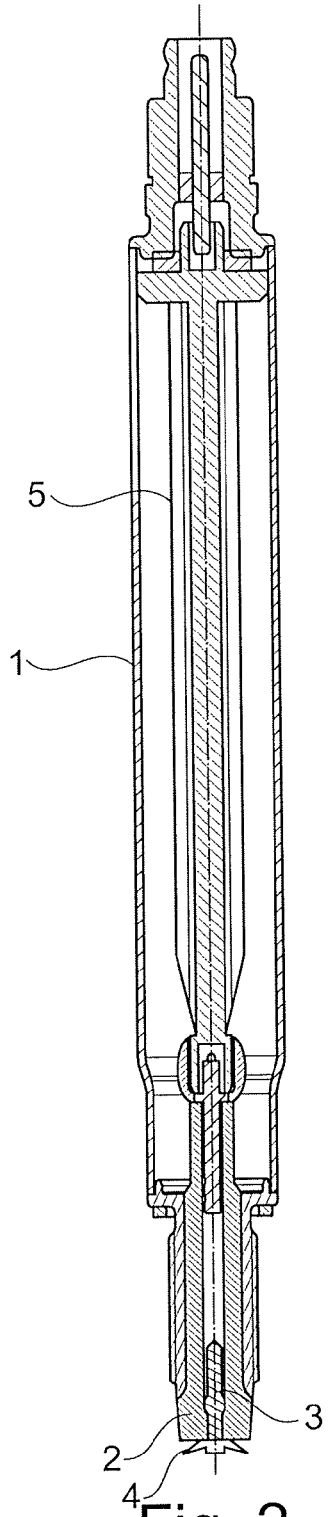
FIG. 2 is a cross-sectional view of FIG. 1.

The corona ignition device shown in FIG. 1 has a housing 1 that is closed on one end by an insulator 2. As is, in particular, shown in FIG. 2, a center electrode 3 which leads to at least one ignition tip is inserted into the insulator 2. By attaching an ignition head 4 with a plurality of ignition tips to the center electrode, it is possible to generate a corona discharge in a bigger volume.

The insulator 2, the housing 1, and the center electrode 3 form together a capacitance which is connected in series with a coil 5 connected to the center electrode 3. This capacitance and the coil 5 arranged in the housing 1 form an electrical resonant circuit. Corona discharges can be generated at the ignition tip or ignition tips by excitation of this resonant circuit.

An end section of the housing 1 which surrounds the insulator 2 can have an external thread to be screwed into an engine block. It is also possible to fasten the corona ignition device to an engine block by other means than by an external thread.

The center electrode 3 can be composed of a plurality of parts, for example, pins which protrude from the insulator 2 at different ends and are connected by means of a glass seal-in in the insulator. The glass seal-in consists of conducting glass, i.e., glass which was made electrically conducting by conducting additives, such as graphite or metal particles. The glass seal-in seals the duct running through the insulator 2, in which the center electrode 3 or, rather, the pins pertaining to the center electrode are seated.

Figure 3:
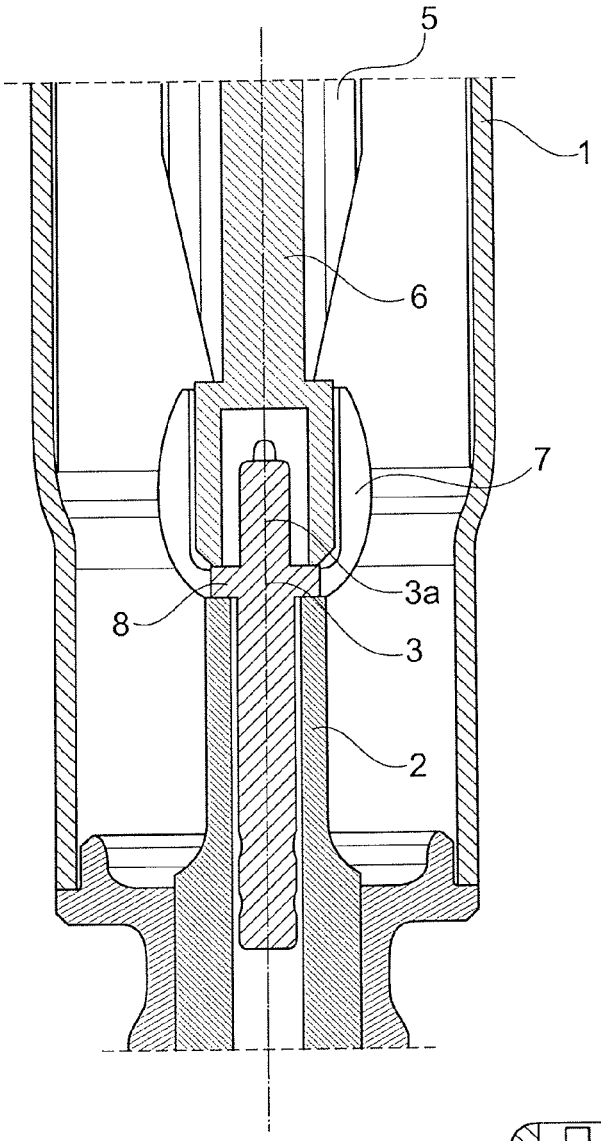
FIG. 3 is a detail view of FIG. 2.

As is, in particular, shown in FIG. 3, the coil 5 is wound onto a coil body 6. A shielding cap 7 is fitted onto an end section of the coil body 6. The shielding cap 7 has a U-shaped cross section with rounded convex outside contours. The shielding cap 7 has a circumferential wall which surrounds the end section of the coil body 6 and projects beyond the bottom of the shielding cap 7 on one side only, namely on the side facing the coil body 6. In its circumferential wall, the shielding cap 7 comprises slots which are continuous all the way to the edge facing the coil. In FIG. 3, the shielding cap is not hatched because the sectional plane of the drawing passes through the slots.

Preferably, the shielding cap 7 is made of metal but can, for example, also consist of electrically conducting ceramic, electrically conducting plastic and/or metallically coated plastic or metallically coated ceramic.

A section 3*a* of the center electrode 3 protrudes through a bottom of the shielding cap 7. This is the section 3*a* onto which the end section of the coil body 6 is fitted and the coil 5 is connected to the center electrode 3 in this manner. The coil body 6 can carry a bush or form a bush, such as is illustrated in FIG. 3. This bush is fitted onto the section 3*a* of the center electrode 3 that protrudes through the bottom of the shielding cap.

The shielding cap 7 can be formed integrally with a pin 3*a* which forms a section of the center electrode 3. Preferably, however, the shielding cap 7 is joined up to a pin which forms a section of the center electrode 3. For example, the shielding cap 7 can form an interference fit assembly with such a pin, i.e., it is pressed or shrunk onto the pin. Another possibility is that the pin is welded to the shielding cap 7. In this case, the shielding cap 7 should be welded to the pin by means of a weld seam which is arranged completely in the interior region of the shielding cap 7.

Figure 4:
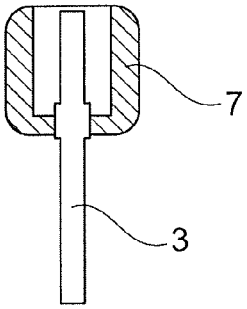
FIG. 4 is a schematic detail view of a further embodiment.
Figure 5:
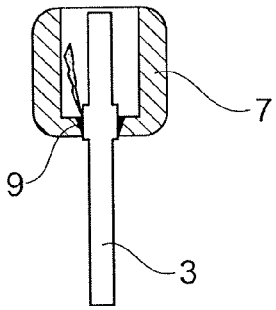
FIG. 5 is a schematic detail view of a further embodiment.

FIG. 4 is a schematic view of a shielding cap 7 that is pressed onto a pin. FIG. 5 is a schematic view of a shielding cap 7 that is welded to a pin wherein the weld seam 9 which connects the pin to the shielding cap 7 is completely arranged in the shielding cap 7. That means that the shielding cap 7 is subject to an influence from welding only from inside. The shielding caps of these embodiments have slots in their circumferential wall, which are not shown in the drawings and reduce eddy current losses.

In the embodiment shown in FIG. 3, the pin comprises a ring shoulder with which it is seated on the insulator 2. This ring shoulder can, for example, be formed by a sealing collar 8 which forms the bottom or a part of the bottom of the shielding cap 7. The sealing collar 8 is arranged between the insulator 2 and the coil body 6. The sealing collar 8 or, rather, the ring shoulder of the pin can, for example, prevent molten glass from flowing out while the glass seal-in is produced.

Figure 6:
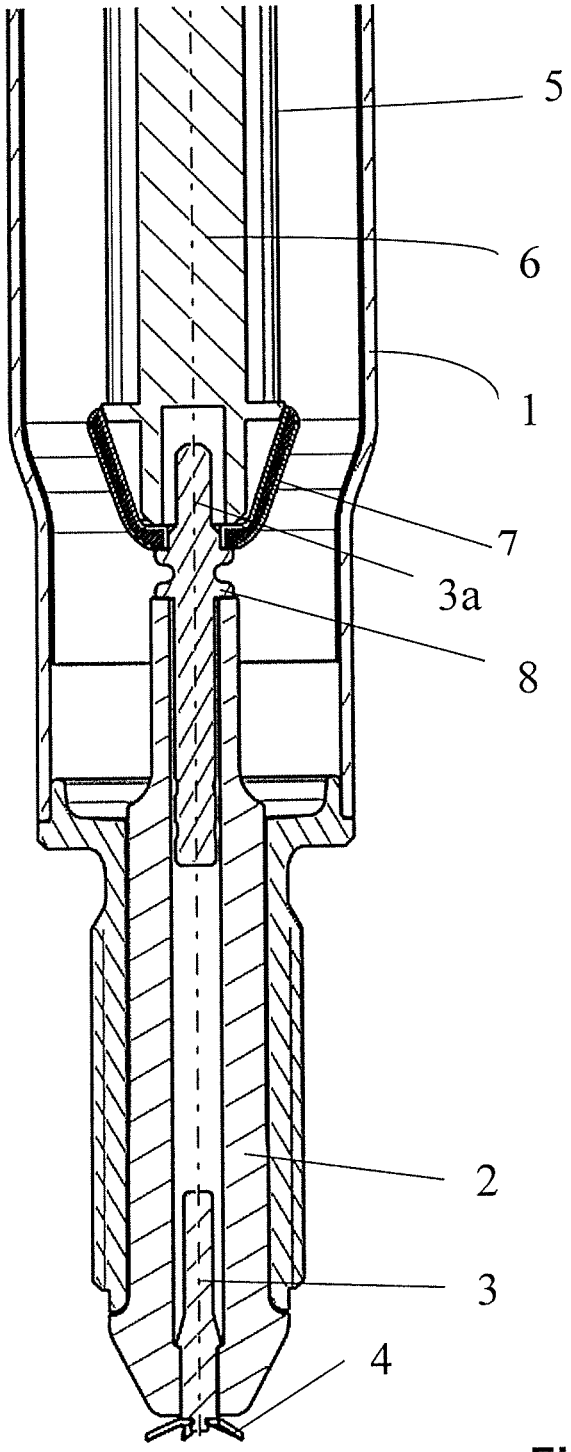
FIG. 6 is a schematic detail view of a further embodiment.

In the embodiment shown in FIG. 6, the shielding cap 7 has a somewhat different shape than in the embodiment shown in FIG. 3. In the embodiment shown in FIG. 3, the circumferential walls of the shielding cap have a convex curvature on their outer side. In the embodiment shown in FIG. 6, however, the circumferential wall of the U-shaped shielding cap 7 is plane over the major part of its length and rounded only at its end facing the coil 5. A further difference from the embodiment shown in FIG. 3 consists in that the coil body 6 does not taper towards the shielding cap 7. The coil body 6 can have a flange which terminates flush with the shielding cap 7.

The shielding cap shown in FIG. 6 can also be used with a tapering coil body.

A further difference between the embodiments shown in FIGS. 3 and 6 also consists in the design of the center electrode. The section 3*a* of the center electrode which protrudes into the shielding cap 7 is disposed adjacent to a flange which abuts against a bottom of the shielding cap 7. The center electrode can have a second flange 8 which abuts against the insulator 2. These two flanges can be combined to form a single flange which will then abut against the shielding cap 7 on one side and against the insulator 2 on the other side.

Figure 7:
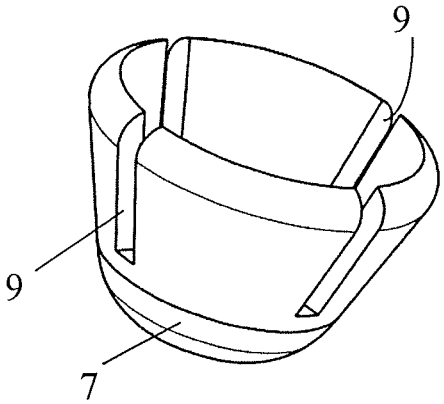
FIG. 7 shows an embodiment of the shielding cap of the embodiment shown in FIG. 6.
Figure 8:
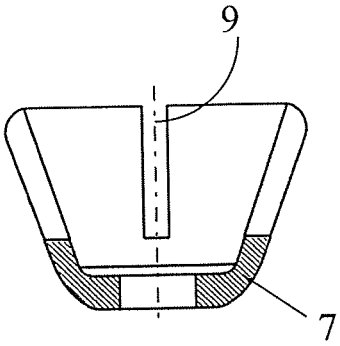
FIG. 8 is a further view of FIG. 7.

FIGS. 7 and 8 show the shielding cap 7 of the embodiment shown in FIG. 6. As can be seen, the circumferential wall of the shielding cap is provided with a plurality of slots 9. The slots each start from an edge of the circumferential wall. The slots 9 bring about a reduction of eddy current losses. In the illustrated embodiment, the slots are open towards the coil. The shielding caps of the other embodiments can also be provided with slots.

The number of slots can be selected almost as desired. In the illustrated embodiment, there are four slots 9. However, the shielding cap 7 can also be provided with only one, two, three or more than four slots 9. As a general rule, two to eight slots are particularly advantageous.

While exemplary embodiments have been disclosed hereinabove, the present invention is not limited to the disclosed embodiments. Instead, this application is intended to cover any variations, uses, or adaptations of this disclosure using its general principles. Further, this application is intended to cover such departures from the present disclosure as come within known or customary practice in the art to which this invention pertains and which fall within the limits of the appended claims.

What is claimed is:

1. A corona ignition device for igniting fuel in an internal combustion engine by means of a corona discharge, comprising:

a center electrode;

an insulator into which the center electrode is inserted;

a coil body onto which a coil is wound, the coil being connected to the center electrode; and a shielding cap fitted onto and having a wall that surrounds an end section of the coil body, said end section facing the insulator;

wherein the shielding cap comprises one or a plurality of slots that extend through the wall, and wherein the shielding cap is an electrical conductor and is at least partially formed from metal.

2. The corona ignition device according to claim 1, wherein a section of the center electrode is formed as a pin and protrudes through a bottom of the shielding cap.

3. The corona ignition device according to claim 2, wherein the coil body carries a bush fitted onto the section of the center electrode that protrudes through the bottom of the shielding cap.

4. The corona ignition device according to claim 1, wherein the shielding cap is formed integrally with the pin which forms a section of the center electrode.

5. The corona ignition device according to claim 1, wherein the shielding cap is connected to the pin by means of interference fit.

6. The corona ignition device according to claim 1, wherein the shielding cap is welded to the pin by a weld seam which is completely arranged in the interior region of the shielding cap.

7. The corona ignition device according to claim 1, wherein the pin comprises a ring shoulder with which it is seated on the insulator.

8. The corona ignition device according to claim 1, wherein the pin comprises a sealing collar which is arranged between the insulator and the coil body.

9. The corona ignition device according to claim 1, wherein a glass seal-in which connects the pin to the insulator is arranged in the insulator.

10. The corona ignition device according to claim 1, wherein the wall comprises a circumferential wall which projects beyond a bottom of the shielding cap on one side only.

11. The corona ignition device according to claim 1, further comprising a housing into which the insulator is inserted.

12. The corona ignition device according to claim 1, wherein the shielding cap comprises a U-shaped cross-section.

13. The corona ignition device according to claim 1, wherein the shielding cap comprises a cup shape.

14. The corona ignition device according to claim 1, wherein the slot or slots originate at one end of the wall.

* * * * *